US005435936A

United States Patent [19]

Broze

[11] Patent Number: 5,435,936

[45] **Date of Patent: * Jul. 25, 1995**

[54] NONAQUEOUS LIQUID MICROEMULSION COMPOSITIONS

[75] Inventor: Guy Broze, Grace-Hollogne, Belgium

[73] Assignee: Colgate Palmolive Co., Piscataway, N.J.

[ * ] Notice: The portion of the term of this patent subsequent to Dec. 20, 2011 has been disclaimed.

[21] Appl. No.: 114,402

[22] Filed: Sep. 1, 1993

[51] Int. Cl.[6] ..... C11D 1/72; C11D 1/12; C11D 3/18; C11D 3/20

[52] U.S. Cl. ..... 252/162; 252/170; 252/173; 252/174.21; 252/DIG. 1; 252/549

[58] Field of Search ..... 252/162, 170, 173, 174.21, 252/DIG. 1, 549

[56] References Cited

U.S. PATENT DOCUMENTS

| | | | |
|---|---|---|---|
| 3,131,153 | 4/1964 | Klausner | 252/305 |
| 3,843,780 | 10/1974 | Michaels et al. | 424/73 |
| 4,035,514 | 7/1977 | Davis | 424/365 |
| 4,176,080 | 11/1979 | Wiss et al. | 252/162 |
| 4,224,152 | 9/1980 | Lepain | 210/729 |
| 4,288,339 | 9/1981 | Wilsberg | 252/90 |
| 4,606,840 | 8/1986 | Gautier et al. | 252/171 |
| 4,650,493 | 3/1987 | Pahlsson et al. | 8/142 |
| 4,659,332 | 4/1987 | Hellsten | 8/142 |
| 4,767,625 | 8/1988 | Mitsuno et al. | 424/95 |
| 4,877,556 | 10/1989 | Wilsberg et al. | 252/544 |
| 4,909,962 | 3/1990 | Clark | 252/547 |
| 4,919,839 | 4/1990 | Durbut et al. | 252/153 |
| 4,985,154 | 1/1991 | Balzer et al. | 252/8.554 |
| 5,031,648 | 7/1991 | Lutener et al. | 134/32 |
| 5,035,826 | 7/1991 | Durbut et al. | 252/121 |
| 5,041,235 | 8/1991 | Kilbarger | 252/170 |
| 5,112,516 | 5/1992 | Koetzle | 252/162 |
| 5,124,062 | 6/1992 | Stevens | 252/162 |
| 5,269,958 | 12/1993 | de Jager | 252/90 |
| 5,282,977 | 2/1994 | Richmann et al. | 252/162 |
| 5,288,420 | 2/1994 | Mandy | 252/121 |
| 5,288,421 | 2/1994 | Mandy | 252/121 |
| 5,374,372 | 12/1994 | Broze et al. | 252/299.01 |

FOREIGN PATENT DOCUMENTS

| | | |
|---|---|---|
| 2846088 | 4/1980 | Germany . |
| 6469699 | 3/1989 | Japan . |
| 2033421 | 5/1980 | United Kingdom . |
| 2266725 | 10/1993 | United Kingdom . |
| 06204 | 4/1993 | WIPO . |
| 17144 | 8/1994 | WIPO . |

OTHER PUBLICATIONS

Lin, Hu Meei, An experimental method for determining Hildebrand solubility Parameter of organic nonelectrolytes, 10–93 pp. 1018–1026 Oct., 1993.

*Primary Examiner*—Paul Lieberman
*Assistant Examiner*—Michael P. Tierney
*Attorney, Agent, or Firm*—Richard M. Nanfeldt; Robert C. Sullivan; Murray Grill

[57] ABSTRACT

The present invention relates to a microemulsion composition having an apparent viscosity at $10^{-2}$ $sec^{-1}$ of about 1 to about 1,000 cps which comprises approximately by weight 5 to 50% of a nonionic surface active agent; 5 to 70% of an aliphatic hydrocarbon having about 9 to 15 carbon atoms; and 10 to 80% of a nonaqueous polar solvent having a Hildebrand hydrogen bonding solubility parameter at 25° C. of at least 12.3 and 0 to 50 of an essentially non aqueous polar cosolvent having a Hildebrand hydrogen bonding solubility parameter at 25° C. of at least 15.4.

18 Claims, 5 Drawing Sheets

NONAQUEOUS LIQUID MICROEMULSION COMPOSITIONS

FIELD OF THE INVENTION

This invention relates to nonaqueous microemulsion compositions and especially in aqueous microemulsion detergent compositions. More specifically, it is of a liquid detergent composition in a miroemulsion state or form, which by virtue of its microemulsion nature and ready convertibility to a cleaning solution, when brought into contact with water, is superior to other liquid detergent compositions in detergency and in other physical properties. In particular, the detergent composition can be a nonaqueous concentrate which upon dilution with water forms a microemulsion.

BACKGROUND OF THE INVENTION

Liquid aqueous synthetic organic detergent compositions have long been employed for human hair shampoos and as dishwashing detergents for hand washing of dishes (as distinguished from automatic dishwashing, machine washing of dishes). Liquid detergent compositions have also been employed as hard surface cleaners, as in pine oil liquids, for cleaning floors and walls. More recently, they have proven successful as laundry detergents too, apparently because they are convenient to use, are instantly soluble in wash water, and may be employed in "pre-spotting" applications to facilitate removal of soils and stains from laundry upon subsequent washing. Liquid detergent compositions have comprised anionic, cationic and nonionic surface active agents, builders and adjuvants including, as adjuvants, lipophilic materials which can act as solvents for lipophilic soils and stains. The various liquid aqueous synthetic organic detergent compositions mentioned above serve, to emulsify lipophilic materials including oily soils in aqueous media, such as wash water, by forming micellar dispersions and emulsions.

Although emulsification is a mechanism of soil removal, it has been only recently that it was discovered how to make microemulsions which are much more effective than ordinary emulsions in removing: lipophilic materials from substrates. Such microemulsions are described in British Patent Specification No. 2,190,681 and U.S. patent applications Ser. Nos. 06/866,029, 07/085,902, 07/120,250 and 07/267,872 most of which relates to acidic microemulsions useful for cleaning hard surface items such as bathtubs and sinks, which microemulsions are especially effective in removing soap scum and lime scale from them. In U.S. patent application Ser. No. 07/267,872 the microemulsions may be essentially neutral and as such are also thought to be effective for microemulsifying lipophilic soils from substrates. In U.S. patent application Ser. No. 07/313,664 there is described a light duty microemulsion liquid detergent composition which is useful for washing dishes and removing greasy deposits from them in both neat and diluted forms. Such compositions includes complexes of anionic and cationic detergents as surface active components of the microemulsions.

The various microemulsions referred to include a lipophile which may be a hydrocarbon, a surfactant which may be an anionic and/or a nonionic detergent(s), a co-surfactant which may be a poly-lower alkylene glycol lower alkyl ether, e.g. tripropylene glycol monomethyl ether, and water.

Although the manufacture and use of detergent compositions in microemulsion form significantly improves cleaning power and greasy soil removal, compared to the usual emulsions, the present invention improves them still further and also increases the capacity of the detergent compositions to adhere to surfaces to which they have been applied. Thus, they drip or run substantially less than cleaning compositions of "similar" cleaning power which are in normal liquid detergent form. Also, because they will probably form gels with water spontaneously depending upon the amount of dilution with water, with essentially no requirement for addition of any energy, either thermal or mechanical, they are more effective cleaners at room temperature, especially for vertical walls in the gel form and at higher and lower temperatures that are normally employed in cleaning operations than are ordinary liquid detergents and are also more effective than detergent compositions in solution form. The instant compositions can be formed as nonaqueous concentrates which the consumer can use by dilution with water thereby minimizing the amount of waste generated.

Nonaqueous microemulsions of glycerol/sodium dodecyl sulfate/hexanol/alkane, of ethylene glycol/lecithin/decane and of ethylene glycol/sodium dodecyl sulfate/toluene/decanol have been disclosed by Friberg and Co. in *Colloids and Surfaces*, 24 (1987) 325–336, in *Colloid and Polymer Science* 262, (1984) 252–253 and in *Colloid and Polymer Science* 268, (1990) 755–759 respectively. Rico and Lattes claim the formation of microemulsions of formamide/cetyltrimethylamonium bromide/cyclohexane/1-butanol, and of formamide/-potassium 2,2,3,3 tetrahydroperfluorounDecanoate/1,1,2,2, tetrahydroperflurohexanol/perflourinated oils in *Nouveau Journal de Chimie* Vol. 8, No. 7, 1984, p 429 and *Journal of Colloid and Interface Science* Vol. 102, No. 1, Nov 1984 respectively. Nonaqueous microemulsions of formamide/nonionic surfactants/hydrocarbons and of formamide/didodecyldimethylamonium bromide/toluene have been disclosed by Warnheim and Co. in *Journal of Colloid and Interface Science* Vol. 131, No. 2, Sept. 1989 and in *Progr. Colloid Polym. Sci*, 82:271–279 (1990) respectively. Durfler and Co. claim the formation of microemulsions of NN dimethyl formamide/Triton®×114/dodecane/n-pentanol, of nitromethane/Triton®×114/dodecane/n-pentanol in Tenside Surf, Det. 28 (1991 ), 3, 167–172. The major part of the above mentioned nonaqueous systems are not environmentally safe for consumer use. Due to ingredient toxicity, the use of nonionic surfactants in combination with aliphatic hydrocarbons and a nonaqueous polar solvent has not been disclosed for the formation of microemulsions in nonaqueous solvents which can be used in consumer detergents.

The nonaqueous microemulsion compositions are applicable for use in concentrated household care products and personal care products because they can contain water-incompatible active ingredients such as bleachants and/or enzymes. The nonaqueous microemulsion compositions of the instant invention comprise harmless ingredients as compared to the formamide used by T. Wamheim and M. Sjoberg which could never be used in household or body care products. The instant microemulsion compositions permit the preparation of super concentrated cleaning or conditioning liquid products containing high levels of nonionic surfactants. The instant nonaqueous microemulsion compositions of the instant invention are less temperature-sensitive than aqueous-based microemulsion compositions of the instant invention and therefore have improved storage stability.

The instant nonaqueous microemulsion compositions can form a gel upon a minimum dilution with water and as such are applicable in oral products. A thin layer of the nonaqueous microemulsion could be sprayed or otherwise deposited on the teeth (or on the brush) and subsequently gelled or thickened by the saliva to allow brushing. In accordance with the present invention, a liquid detergent composition, suitable at room temperature or colder or at a higher temperature for pre-treating and cleaning materials soiled with a lipophilic soil, is in a nonaqueous microemulsion form and comprises a nonionic surface active agent, an aliphatic hydrocarbon, a nonaqueous polar solvent and, optionally, a polar co-solvent. The invention also relates to processes for treating items and materials soiled with soils such as a lipophilic soil, with compositions of this invention, to loosen to remove such soil by applying to the locus of such soil on such material a soil loosening or removing amount of the compositions of the microemulsion compositions of the instant invention. The invention is also being in the conversion of the nonaqueous microemulsion liquid composition by the addition of water thereto into a gel or a solution depending upon the amount of the water addition. In another aspect of the invention, lipophilic soil is absorbed from the soiled surface into the nonaqueous microemulsion and then contacted with water so as to convert the microemulsion to solution form.

SUMMARY OF THE INVENTION

The instant invention relates to a liquid crystal or pseudo microemulsion composition having an apparent viscosity at $10^2$ $sec^{-1}$ of about 1 to 1000 cps, more preferably about 1 to 700 cps which comprises approximately by weight 7 to 50% of a nonionic surface active agent; 5 to 70% of an aliphatic hydrocarbon having about 9 to 15 carbon atoms; 0 to 50% of an essentially nonaqueous polar cosolvent having a Hildebrand hydrogen bonding solubility parameter at 25° C. of at least 15.4 and a Hildebrand polar solubility parameter at 25° C. of at least 5 and 10 to 80% of a nonaqueous polar solvent having a :Hildebrand hydrogen bonding solubility parameter at 25° C. of at least 12.3 and a Hildebrand polar solubility parameter at 25° C. of at least about 8 $(MPa)^{\frac{1}{2}}$.

Accordingly, it is an object of the instant invention to provide a microemulsion composition which is useful in a cleaning operation and is possibly convertible into a gel by contacting the microemulsion composition with water, wherein the gel is further convertible into a solution by contacting the gel with a further amount of water.

Another object of the instant invention is to provide a nonaqueous microemulsion medium for water sensitive materials such as enzymes and/or bleachants.

A still further object is to provide a detergent composition in a microemulsion form which exhibits improved adherence onto vertical surfaces, when the composition is applied to the vertical surfaces in neat form such as by spraying.

DETAILED DESCRIPTION OF THE INVENTION

Figure 1:
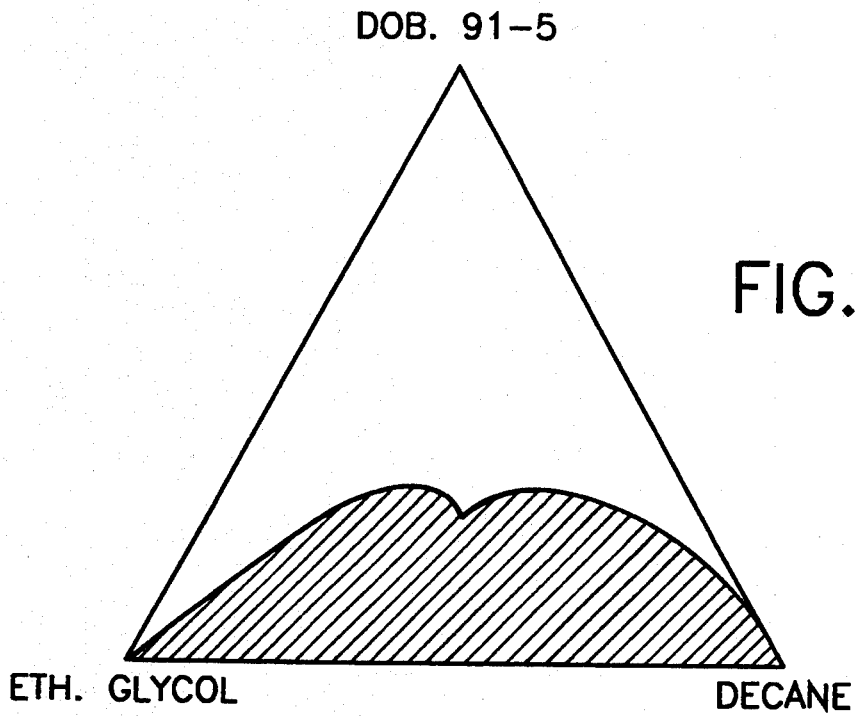
FIGS. 1-9 illustrate phase diagrams for microemulsion compositions of Example I.
Figure 2:
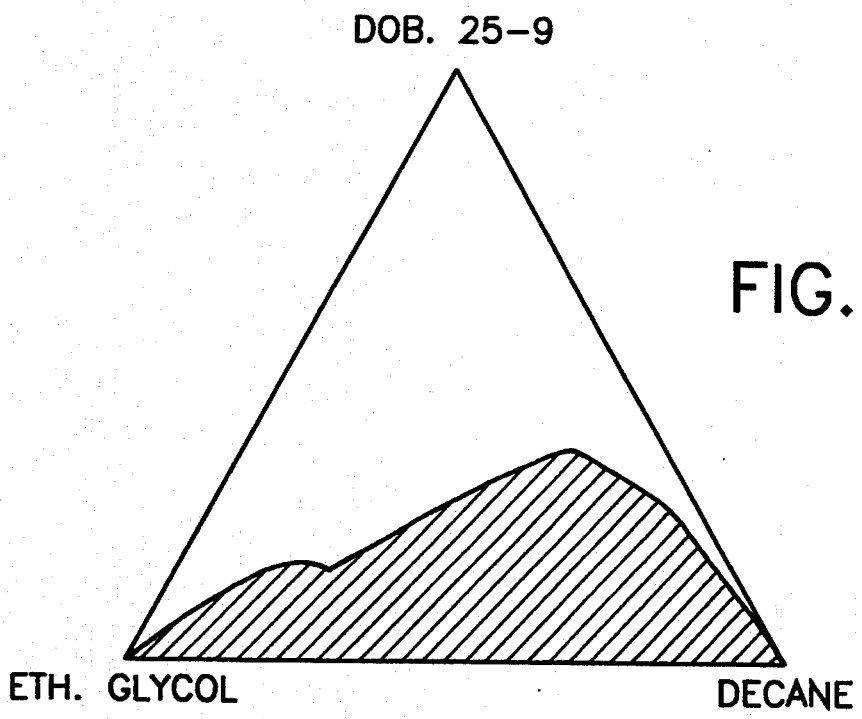
Figure 3:
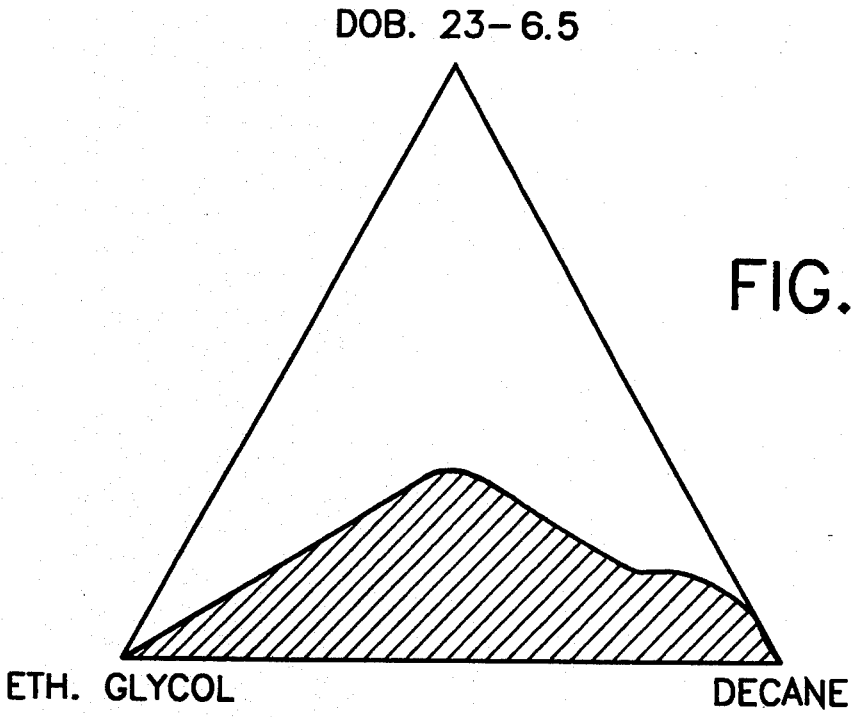
Figure 4:
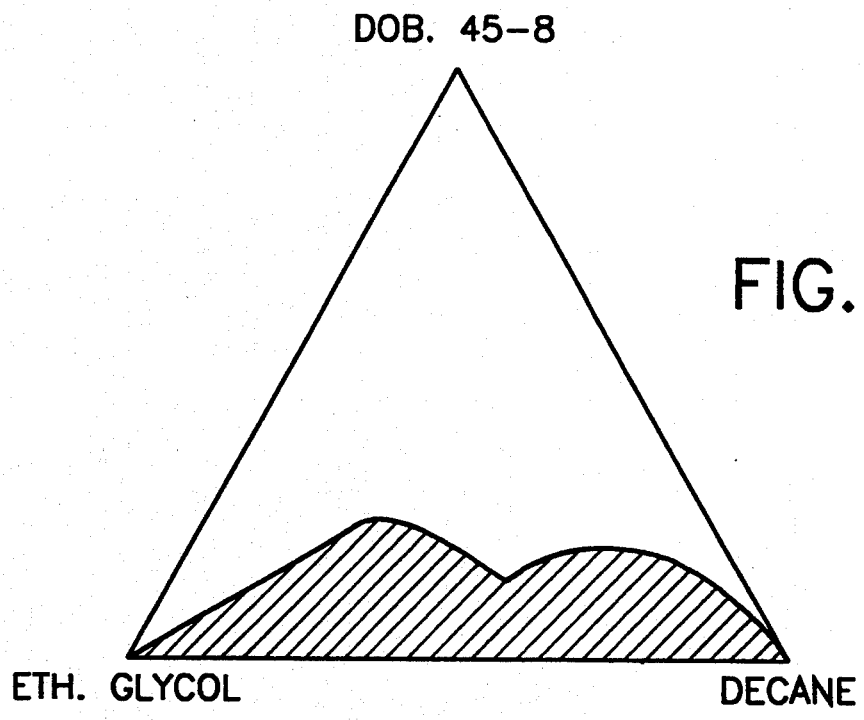
Figure 5:
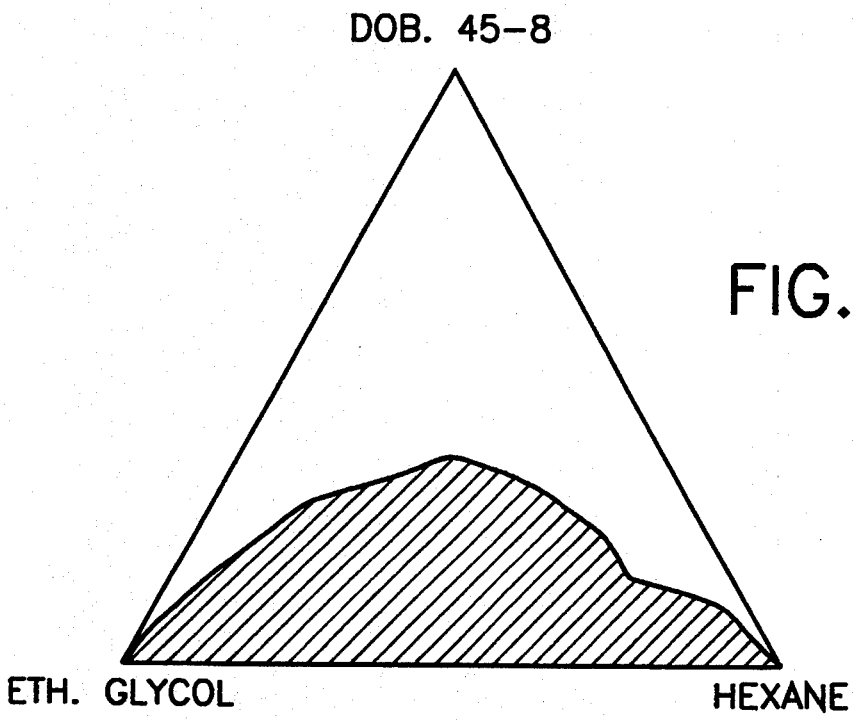
Figure 6:
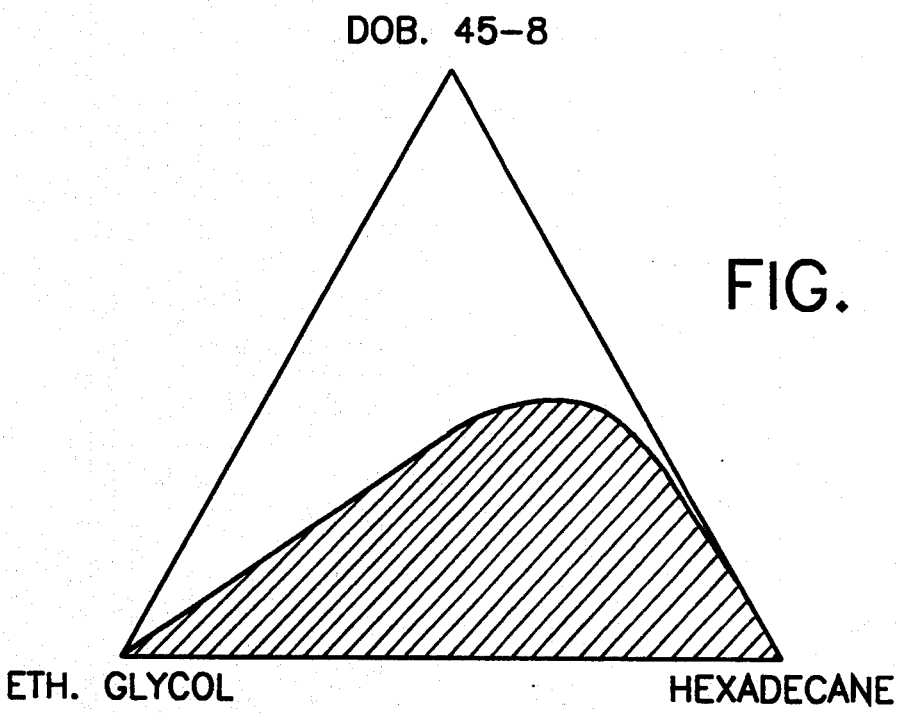
Figure 7:
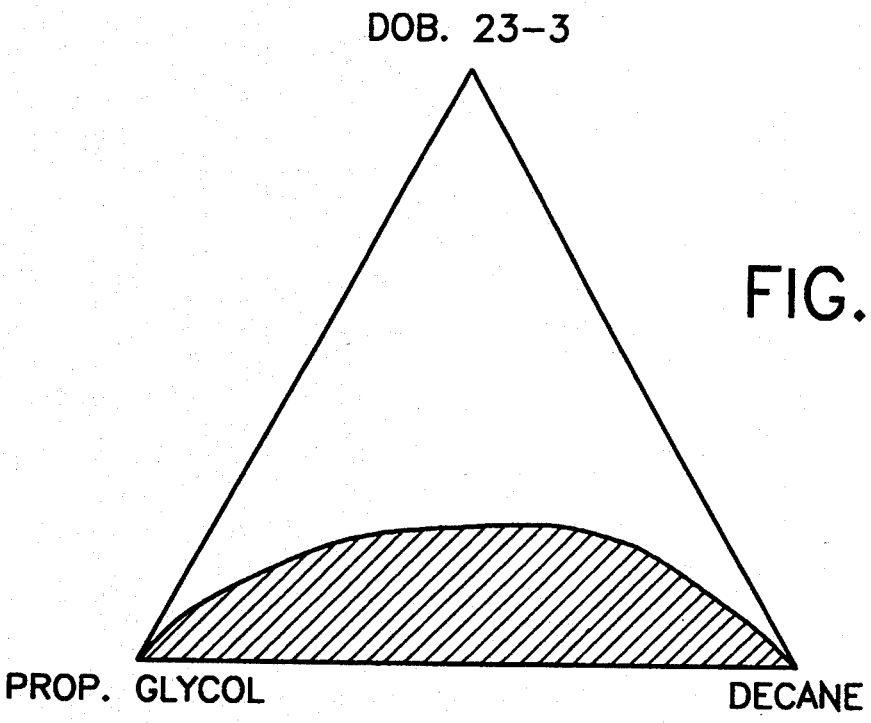
Figure 8:
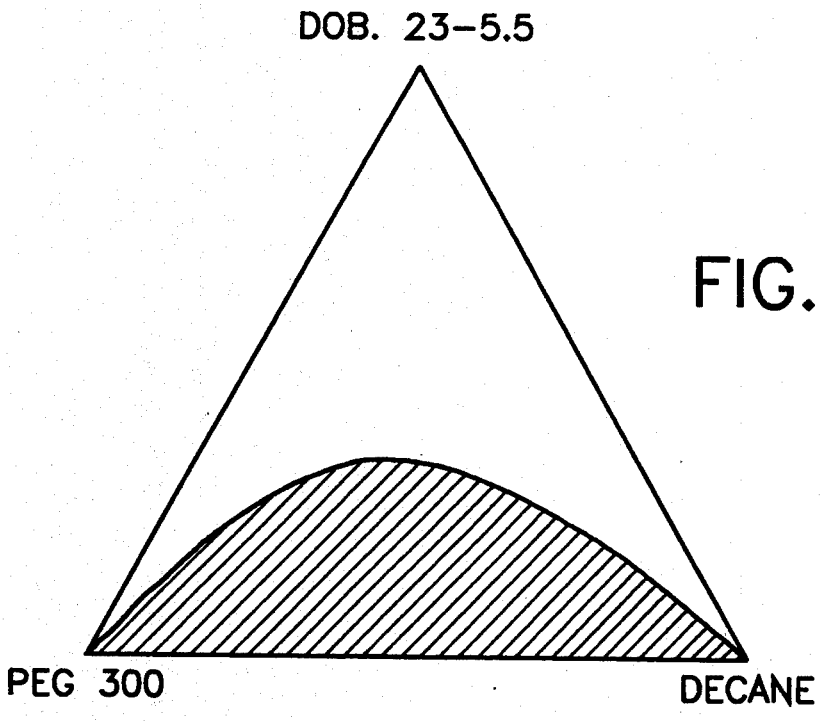
Figure 9:
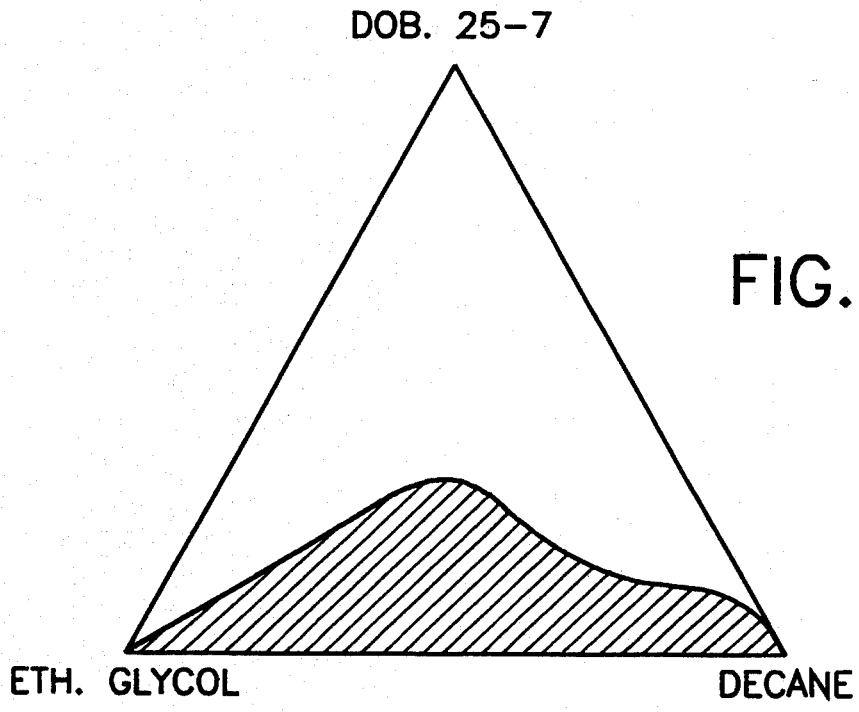

The present invention relates to a microemulsion or liquid crystal composition having an apparent viscosity $10^2$ $sec^{-1}$ of about 1 to about $10^3$ cps, more preferably about 1 to about 100 cps, which comprises approximately by weight:

a) 7 to 50% of a nonionic or ionic surface active agent, more preferably 8 to 45% and most preferably 10 to 45%;

b) 5 to 70%, more preferably 5 to 40% and most preferably 10 to 25%, of an aliphatic hydrocarbon which has about 6 to 15 carbon atoms and more preferably 10 to 14 carbon atoms having a Hildebrand solubility dispersion parameter at 25° C. of at least about 15.6; or alternatively and less preferred a polar oil;

c) 10 to 90%, more preferably 15 to 60% and most preferably 15 to 55%, of an essentially nonaqueous polar solvent having a Hildebrand hydrogen bonding solubility parameter at 25° C. of at least 12.2 and more preferably at least 15 and a Hildebrand polar solubility parameter at 25° C. of at least 5, more preferably at least 10;

d) 0 to 45%, more preferably 0.5 to 25% and most preferably 1 to 5%, of an essentially nonaqueous polar co-solvent having a Hildebrand hydrogen bonding solubility parameter at 25° C. of at least 15.4 and a Hildebrand polar solubility parameter at 25° C. of at least about 5, more preferably at least about 10.

The microemulsion compositions of the instant invention can be used as a basic formulation for the production of both commercial and industrial applications by the addition of selective ingredients to the microemulsion composition. Typical compositions which can be formed for a variety of applications are toothpastes, creams or toothpaste gels, cosmetics, hand creams, facial creams, eye shadows, lipsticks, metal polish agents, fabric cleaners, shampoos, floor cleaners, cleaning pastes, tile cleaners, bleach compositions, ointments, oven cleaners, stain removers, fabric softeners, bleach pre-spotters, automatic dishwashing compositions, laundry pre-spotters, pharmaceutical compositions, coal slurries, oil drilling muds, and cleaning pre-spotters.

The nonionic mad ionic surfactants and synthetic organic detergents that are employed in the instant cleaning compositions are preferably water soluble, but such materials that are water dispersible can also be used. The soluble nonionic compounds are usually condensation products of an organic aliphatic or alkylaromatic hydrophobic compound and a lower alkylene oxide, such as ethylene oxide or the combination of ethylene oxide and propylene oxide which is hydrophilic. Almost any hydrophobic compound having a carboxy, hydroxy, amido or amino group with a free hydrogen present can be condensed with ethylene oxide or ethylene oxide in combination with propylene oxide or with polyethylene glycol to form a nonionic detergent. The length of the polyethenoxy chain of the condensation product can be adjusted to achieve the desired balance between the hydrophobic and hydrophilic elements (hydrophilic-lipophilic balance, or HLB).

Particularly suitable nonionic detergents are the condensation products of a higher aliphatic alcohol, such as a fatty alcohol, containing about 7 to 22, more preferably 10 to 18 carbon atoms, in a straight (or branched) chain configuration, condensed with about 4 to 13, preferably 5 to 12, more preferably 5 to 11 and most preferably 5 to 10 moles of ethylene oxide to one mole of the aliphatic alcohol. Particularly preferred such compounds are $C_1$ 9–11 alkanol ethoxylates and 5–8 moles of ethylene oxide, which also may be designated at C 9–11 alcohol EX(EO) wherein X=5 to 8. Particularly preferred nonionic surfactants are Dobanol 45–8 which is $C_{14-15}$ fatty alcohol and 8 ethylene oxide, Dobanol 23-7 which is $C_{12-13}$ fatty alcohol and 7 ethylene oxide, and Dobanol 91-5 which is $C_{9-11}$ fatty alcohol and 5 ethylene oxide.

Other possible :suitable nonionic detergents are the polyethylene oxide condensates of one mole of alkyl phenol containing from about 8 to 20 carbon atoms in a straight or branched chain configuration, with about 5 to 13, preferably 6 to 11 moles, of ethylene oxide such as decyl phenol condensed with 8 moles of ethylene oxide. These aromatic compounds are not as desirable as the aliphatic alcohol ethoxylates in the instant compositions because they are not as biodegradable.

Another well-known group of usable nonionic detergents is marketed under the trade name "Pluronics." These compounds are block co-polymers formed by condensation of ethylene oxide with a hydrophobic base formed by the condensation of propylene oxide with propylene glycol. The molecular weight of the hydrophobic portion of the molecule is of the order of 950 to 4000, preferably 1200 to 2500. The condensation of ethylene oxide with the hydrophobic moiety increases the water solubility of the hydrophobe. The molecular weight of these polymers is in the range of 1000 to 15,000 and the polyethylene oxide content may comprise 20 to 80% thereof.

Still other satisfactory nonionic detergents are condensation products of a $C_{8-13}$ alkanol with a heteric mixture of ethylene oxide and propylene oxide. The mole ratio of ethylene oxide to propylene oxide is from at least 1:1 to 4:1, preferably from 1.5:1 to 3.0:1 with the total weight of the ethylene oxide and propylene oxide contents (including the terminal ethanol group or propanol group) being from 60% to 85%, preferably 70% to 80%, of the molecular weight of the nonionic detergent. The higher alkanol may contain 8 to 20 carbon atoms and one such nonionic detergent is the condensation product of $C_{13-15}$ alkanol with 4 moles of propylene oxide and 7 moles of ethylene oxide, which is available from BASF Corp. under the trade name Plurafac LF400.

Also suitable for incorporation in the invented cleaning compositions are the nonionic detergents that are derived from the condensation of the ethylene oxide with the product resulting from the reaction of propylene oxide and ethylene diamine, for example, satisfactory such compounds contain from about 40 to 80% of polyoxyethylene by weight, have a molecular weight of from about 5000 to 11,000, and result from the reaction of ethylene oxide with a hydrophobic base which is a reaction product of ethylene diamine and excess propyoxyethylene oxide, which base is of a molecular weight in the range of 2500 to 3000. Other nonionic surfactants envisioned within the scope of the instant invention are, stearate or isostearate surfactants containing glycerol or soribitan moieties, sulfosuccinates, nonionic surfactants based on Guerbet alcohols, and polymeric surfactants with polycarboxylic backbones.

The alkylpolysaccharides surfactants which are also useful alone or in conjunction with the aforementioned surfactants and have a hydrophobic group containing from about 8 to about 20 carbon atoms, preferably from about 10 to about 16 carbon atoms, most preferably from 12 to 14 carbon atoms, and polysaccharide hydrophilic group containing from about 1.5 to about 10, preferably from 1.5 to 4 and most preferably from 1.6 to 2.7, saccharide units (e.g. galactoside, glucoside, fructoside, glucosyl, fructosyl and/or galactosyl units). Mixtures of saccharide moieties may be used in the alkylpolysaccharide surfactants. The number x indicates the number of saccharide units in a particular alkylpolysaccharide surfactant. For a particular alkylpolysaccharide molecule, x can only assume integral values. In any physical sample it can be characterized by the average value of x and this average value can assume non-integral values. In this specification the values of x are understood to be average values. The hydrophobic group (R) can be attached at the 2-, 3- or 4-positions rather than at the 1-position (thus giving, e.g., a glucosyl or galactosyl as opposed to a glucoside or galactoside). However, attachment through the 1-position, i.e. glucosides, galactosides, fructosides, etc., is preferred. In the preferred product the additional saccharide units are predominantly attached to the previous saccharide unit's 2-position. Attachment through the 3-, 4- and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched, containing from about 8 to about 20, preferably from about 10 to about 16, carbon atoms. Preferably the alkyl group is a straight chain saturated alkyl group. The alkyl group can contain up to 3 hydroxy groups and/or the polyalkoxide chain can contain up to about 30, preferably less than 10 and most preferably 0, alkoxide moieties.

Suitable alkylpolysaccharides are decyl, dodecyl, tetradecyl, pentadecyl, hexadecyl and octadecyl, di-, tri-, tetra-, penta- and hexaglucosides, galactosides, lactosides, fructosides, frutcosyls, lactosyls, glucosyls and/or galactosyls, and mixtures thereof.

The alkyl monosaccharides are relatively less soluble in water than the higher alkylpolysaccharides. When used in admixture with alkylpolysaccharides, the alkylmonosaccharides arc solubilized to some extent. The use of alkylmonosaccharides in admixture with alkylpolysaccharides is a preferred mode of carrying out the invention. Suitable mixtures include coconut alkyl, di-, tri-, tetra- and pentaglucosides and tallow alkyl tetra-, penta- and hexaglucosides.

The preferred alkylpolysaccharides are alkylpolyglucosides having the formula:

$$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3, preferably 2; r is from 0 to about 10, preferably 0; and x is from 1.5 to about 8, preferably from 1.5 to 4 and most preferably from 1.6 to 2.7. To prepare these compounds a long-chain alcohol ($R^2OH$) can be reacted with glucose in the presence of an acid catalyst to form the desired glucoside. Alternatively the alkylpolyglucosides can be prepared by a two-step procedure in which a short-chain alcohol ($R_1OH$) can be reacted with glucose in the presence of an acid catalyst to form the desired glucoside. Alternatively the alkylpolyglucosides can be prepared by a two-step procedure in which a short-chain alcohol ($C_{1-6}$) is reacted with glucose or a polyglucoside (x=2 to 4) to yield a short-chain alkyl glucoside (x=1 to 4) which can in turn be reacted with a longer chain alcohol ($R^2OH$) to displace the short-chain alcohol and obtain the desired alkylpolyglucoside. If this two-step procedure is used, the short-chain alkylglucoside content of the final alkylpolyglucoside material should be less than 50%, preferably less than 10%, more preferably less than 5% and most preferably 0%, of the alkylpolyglucoside.

The amount of unreacted alcohol (the free fatty alcohol content) in the desired alkylpolysaccharide surfactant is preferably less than about 2%, more preferably less than about 0.5% by weight, of the total alkylpolysaccharide. For some uses it is desirable to have the alkylmonosaccharide content less than about 10%.

The term used herein, "alkylpolysaccharide surfactant," is intended to represent both the preferred glucose and galactose derived surfactants and the less preferred alkylpolysaccharide surfactants. Throughout this specification, alkylpolyglucoside" is used to include alkylpolyglycosides because the stereo chemistry of the saccharide moiety is changed during the preparation reaction.

An especially preferred APG glycoside surfactant is APG 625 glycoside manufactured by the Henkel Corp., Ambler, PA. APG 625 is a nonionic alkylpolyglycoside characterized by the formula:

$$C_nH_{2n+1}O(C_6H_{10}O_5)_xH$$

wherein n=10 (2%); n=12 (65%); n=14 (21–28%); n=16 (4–8%); and n=18 (0.5%) and x (degree of polymerization)=1.6. APG 625 has a pH of 6–8 (10% of APG 625 in distilled water); a specific gravity at 25° C. of 1.1 grams/ml; a density at 25° C. of 9 lbs/gallon; a calculated HLB of about 12.1; and a Brookfield viscosity at 35° C., 21 spindle, 5–10 rpm of about 3000 to about 7000 cps. Mixtures of two or more of the liquid nonionic surfactants can be used and in some cases advantages can be obtained by the use of such mixtures.

Other nonionic surfactants envisioned within the scope of the instant invention are, stearate or isostearate surfactants containing glycerol or sorbitan moieties, sulfosuccinates, nonionic surfactants based on Guerbet alcohols, and polymeric surfactants with polycarboxylic backbones.

A preferred nonionic surfactant of the instant invention is characterized by the formula:

$$CH_3—(CH_2)_n—O—(CH_2—CH_2—O)_mH$$

wherein n is 8 to 17 and m is 5 to 10, wherein m is equal to 5 to 8 is preferred.

Other preferred anionic surfactants are characterized by the formulas:

$$R—O(CH_2—CH_2—O)_a(CH_2—\overset{CH_3}{\overset{|}{C}}H—O)_bH$$

-continued $$R''—O(CH_2—CH_2—O)_c(CH_2—\overset{CH_3}{\overset{|}{C}}H—O)_d(CH_2—CH_2—O)_eH$$

$$R'''—O(\overset{CH_3}{\overset{|}{C}}H—CH_2—O)_f(CH_2—CH_2—O)_g(\overset{CH_3}{\overset{|}{C}}H—CH_2—O)_hH$$

wherein R' is an aliphatic hydrocarbon chain having about 8 to about 17 carbon atoms, R'' is an aliphatic hydrocarbon chain having about 8 to about 17 carbon atoms, R''' is an aliphatic hydrocarbon chain having about 8 to about 17 carbon atoms, a is about 20 to about 100 mole %, b=100−a, c+e is about 20 to about 100 mole %, d=100−(c+e), f+h is about 0 to about 80 mole %, and g=100−(f+h).

The organic hydrocarbon solvent component of the present microemulsion compositions includes solvents for the soils, is lipophilic, and is a suitable oil such as a polar oil or more preferably a non-polar oil which is preferably an aliphatic hydrocarbon of 9 to 18 carbon atoms and has the formula $C_nH_{2n+2}$, wherein n is 9 to 18 more preferably 10 to 16. Such an aliphatic hydrocarbon is desirably a normal paraffin or an isoparaffin and of these, those which are saturated and of 9 to 16 carbon atoms are preferred, with isoparaffins of 10 to 14 carbon atoms being also preferred. The most preferred aliphatic hydrocarbon solvent is decane. The aliphatic hydrocarbon solvent has a Hildebrand dispersion solubility parameter at 25° C. of at least about 14.8, more preferably at least about 15.8.

The essentially nonaqueous polar solvents used in the formation of the microemulsion compositions have a Hildebrand dispersion solubility parameter at 25° C. of at least about 10.8 and more preferably at least about 16. The polar nonaqueous solvent also has a Hildebrand hydrogen bonding solubility parameter at 25° C. of at least 12.3 and more preferably at least 15.1. Typical nonaqueous polar solvents are diethylene glycol, triethylene glycol, glycerol, ethylene glycol, propylene glycol, polyethylene glycol 300, and ethanol amine, and mixtures thereof, wherein ethylene glycol is a preferred polar solvent.

An essentially polar co-solvent having a Hildebrand dispersion solubility parameter at 25° C. of at least about 16.0 mad a Hildebrand hydrogen bonding solubility parameter at 25° C. of at least 15.4 can be used to expand the microemulsion composition range on the polar solvent/nonionic surfactant/hydrocarbon phase diagram by the modification of the liphobocity of the nonaqueous polar solvent by the more or less polar co-solvent. A preferred nonaqueous polar co-solvent is glycerol.

In addition to the recited components of the microemulsion compositions of the present invention, there may also be present adjuvant materials for dental, dishwashing, laundering and other detergency applications, which materials may include: foam enhancing agents such as lauric or myristic acid diethanolamide; foam suppressing agents (when desired) such as silicones, higher fatty acids and higher fatty acid soaps; preservatives and antioxidants such as formalin and 2,6-ditert-butyl-p-cresol; pH adjusting agents such as sulfuric acid and sodium hydroxide; perfumes; colorants (dyes and pigments); and opacifying or pearlescing agents, if desired.

The microemulsion compositions can be used in forming cleaning compositions containing enzymes and/or bleachants such as fabric detergent compositions or automatic dishwashing compositions which can contain bleachants, at least one enzyme, a suitable phosphate or nonphosphate builder system. The automatic dishwashing composition formed from the microemulsion composition can contain alkali metal silicates, bleachants as well as any of the genetic types of enzymes such as protease, amylase and lipase enzymes.

A typical detergent composition comprises:

Dobanol 45.8 17%
Decane 48%
Ethylene Glycol 33%
Protease Enzyme 1.0%
Amylase Enzyme 1.0%

The phase transformation which can occur between microemulsion and gels and solutions resulting from the use of the invention, and the variations in formulas of compositions within the invention which are in microemulsion state, are easily ascertainable and the invention is readily understood when reference is made to this specification, including the working examples thereof, taken in conjunction with the phase diagrams, (FIGS. 1–11 ). For example, FIG. 1 is a phase diagram of Dobanol 91-5, decane and ethylene glycol, which is composition A of Example I.

In the previous description of the components of the invented compositions and proportions thereof which may be operative, boundaries were drawn for preferred compositions within the invention but it will be evident that one seeking to manufacture the invented microemulsion compositions and will select proportions of components indicated by the phase diagrams for the particular compositions, so that the desired compositions will be within the microemulsion area. Similarly, the compositions selected could be such that upon contact with water and the lipophilic soil to be removed from a substrate, the microemulsion composition will be preferably first transformed into a gel and upon the future addition of water into a solution.

For plotting of the phase diagrams and in experiments undertaken by the inventors to establish the formulas of the desired microemulsion compositions, many different compositions within the invention were made and were characterized.

To make the microemulsion compositions of the invention is relatively simple because they tend to form spontaneously with little need for the addition of energy to promote transformation of the microemulsion state. However, to promote uniformity of the composition, mixing will normally be undertaken and it has been found desirable, but not compulsory, to first mix the surfactants and polar solvent together, followed by admixing of the aliphatic hydrocarbon solvent component. It is not usually necessary to employ heat to melt the nonionic surfactant and most mixings are preferably carried out at about 20°–25° C. or higher. The gel concentrates, made from the microemulsion compositions, which may be made by dilution with water of the microemulsion, are also manufactured according to the same procedure.

Pre-spotting and manual cleaning uses of the invented microemulsion detergent compositions are uncomplicated, requiring no specific or atypical operations. Thus, such compositions may be employed in the same manner as other liquid pre-spotting and detergent compositions. Because the transformation to gel state from the microemulsion state by contact with water and absorption of lipophilic soil is spontaneous and occurs at room temperature (and even at colder temperatures) it is not necessary to heat the microemulsion compositions nor the substrate before application of the microemulsion detergent (or pre-spotting agent) to the surface to be cleaned. The invented microemulsion compositions may be applied to such surfaces by pouring onto them, by application with a cloth or sponge, or by various other contacting means, but it is preferred to apply them depending on their viscosity in the form of a spray by spraying them onto the substrate from a hand or finger pressure operated sprayer or squeeze bottle. Such application may be applied onto hard surfaces such as dishes, walls or floors from which lipophilic (usually greasy or oily) soil is to be removed, or may be applied onto fabrics such as laundry which has previously been stained with lipophilic soils such as motor oil. The invented compositions may be used as detergents and as such may be employed in the same manner in which liquid detergents are normally utilized in dishwashing, floor and wall cleaning, and laundering but it is preferred that they be employed as pre-spotting agents too, in which applications they are found to be extremely useful in loosening the adhesions of lipophilic soils to substrates, thereby promoting much easier cleaning with application of more of the same invented detergent compositions or by applications of different commercial detergent compositions in liquid, bar or particulate forms. As was previously indicated, the microemulsion compositions can spontaneously convert to gels upon contact with lipophilic soil and water, and such microemulsion formation effectively weakens the bond of the soil to the substrate. After it is in the gel state, the soil is readily transferred to aqueous washing or rinsing media by additional contact with water, which makes it very easily removable from the substrate. The absorption of the lipophilic soil by the microemulsion detergent composition is accompanied by a change in the nature of the composition. The gel state of the detergent is of a greater viscosity and adhesion than the microemulsion. Thus, when sprayed onto a surface such as a vertical wall, the present cleaning compositions adhere to it and do not run or drip excessively, thereby allowing the detergent to work on the lipophilic soil more effectively. When the transformation to gel form has taken place, a sign of it will be thickening of the product and less sagging of detergent from the original locus of application. The addition of further water to the gel converts the gels into a solution or turbid emulsion, thereby facilitating the removal of the detergent composition from the substrate by sponging, rinsing, etc. While the advantages of a thicker and more adhering microemulsion and/or gel detergent composition are more significant for wall cleaning than for dishwashing, floor cleaning or laundering, even in the cases of such horizontal surfaces or surfaces which can be maintained horizontal, the applied microemulsion detergent composition or gel form after contact with a minimum amount of water substantially remains at the locus of the lipophile and thereby is better able to perform its cleaning function.

The following example illustrates but does not limit the invention. Unless otherwise indicated, all parts in these examples, in the specification and in the appended claims are by weight percent and all temperatures are in ° C.

EXAMPLE I

The formulas A through K were prepared according to the following procedure:

| | A | B | c | D | E |
|---|---|---|---|---|---|
| Dobanol 91-5 | 30 | | | | 26.9 |
| Dobanol 25-9 | | 20 | | | |
| Dobanol 45-8 | | | 15 | 20 | |
| Sodium lauryl sulfate | | | | | 5.2 |
| Ethylene glycol | 35 | 55 | 35 | 20 | 36.6 |
| Decane | 35 | 25 | 50 | 60 | 31.3 |
| Viscosity at 1 $sec^{-1}$ (Pa s) | 0.024 | 0.050 | 0.032 | 0.034 | 0.050 |
| Viscosity at 100 $sec^{-1}$ (Pa s) | 0.022 | 0.045 | 0.023 | 0.022 | 0.034 |
| FIG. No. | 1 | 2 | 4 | 4 | |

| | F | G | H | I | J | K |
|---|---|---|---|---|---|---|
| Dobanol 23-6.5 | | | | | 19 | |
| Dobanol 25-7 | | | | | | 17 |
| Dobanol 45.8 | 20 | 25 | | | | |
| Dobanol 23-3 | | | 25 | | | |
| Dobanol 23-5.5 | | | | 35 | | |
| Hexane | 67 | | | | | |
| Hexadecane | | 15 | | | | |
| Decane | | | 37.5 | 32.5 | 64 | 64 |
| Ethylene glycol | 13 | 60 | | | 17 | 19 |
| Propylene glycol | | | 37.5 | | | |
| PEG 300 | | | | 32.5 | | |
| Viscosity at 1 $sec^{-1}$ (Pa s) | 0.010 | 0.083 | 0.022 | 0.023 | 0.015 | 0.014 |
| Viscosity at 100 $sec^{-1}$ (Pa s) | 0.0036 | 0.072 | 0.018 | 0.022 | 0.008 | 0.009 |
| FIG. No. | 5 | 6 | 7 | 8 | 3 | 9 |

Compositions A through K were made by first forming with mixing at room temperature a solution of the Dobanol nonionic or SLS surfactant and the nonaqueous polar solvent. To this solution at room temperature was added with mixing the nonaqueous hydrocarbon solvent to form the microemulsions A through K. The apparent viscosity measurements were made at 25° C. on a Carri-med.

The invention has been described with respect to various embodiments and illustrations of it but is not to be considered as limited to these because it is evident that one of skill in the art with the present specification before him/her will be able to utilize substitutes and equivalents without departing from the invention.

What is claimed is:

1. A nonaqueous composition having an apparent viscosity at $10^{-2}$ $sec^{-1}$ of about 1 to about 100,000 cps which comprises approximately by weight:

(a) 10% to 50% of a nonionic surface active agent which is a condensation product of one mole of a fatty alcohol having 8 to 16 carbon atoms and 5 to 9 moles of ethylene oxide;

(b) 5% to 70% of decane;

(c) 10 to 80% of ethylene glycol; and (d) 0 to 45% of glycerol.

2. A composition according to claim 1 wherein said composition is sprayable by a hand operated pump sprayer.

3. A composition according to claim 1 wherein said composition is transformed into a gel when contacted with water at a weight ratio of water to said composition of about 1.5 to about 4.

4. A composition according to claim 1 wherein said composition is transformed into an aqueous solution when contacted with water at the weight ratio of water to composition equal to or greater than about 1:1.

5. A composition according to claim 1 further including about 0.1 to about 10 wt. % of at least one water sensitive material suspended in said composition.

6. A composition according to claim 5 wherein said water sensitive material is an enzyme or bleachant.

7. A composition according to claim 5 containing at least one solid particle or immiscible liquid or both in said composition.

8. A composition according to claim 1 wherein said composition is a microemulsion.

9. A composition according to claim 1 wherein said composition is a liquid crystal.

10. A nonaqueous composition having an apparent viscosity at $10^{-2}$ $sec^{-1}$ of about 1 to about 100,000 cps which comprises approximately by weight:

(a) 10% to 50% of a surface active agent which is dioctyl sulfosuccinate;

(b) 5% to 70% of decane;

(c) 10 to 80% of ethylene glycol; and (d) 0 to 45% of glycerol.

11. A composition according to claim 10 wherein said composition is sprayable by a hand operated pump sprayer.

12. A composition according to claim 10 wherein said composition is transformed into a gel when contacted with water at a weight ratio of water to said composition of about 1.5 to about 4.

13. A composition according to claim 10 wherein said composition is transformed into an aqueous solution when contacted with water at the weight ratio of water to composition equal to or greater than about 1:1.

14. A composition according to claim 10 further including about 0.1 to about 10 wt. % of at least one water sensitive material suspended in said composition.

15. A composition according to claim 14 wherein said water sensitive material is an enzyme or bleachant.

16. A composition according to claim 14 containing at least one solid particle or immiscible liquid or both in said composition.

17. A composition according to claim 10 wherein said composition is a microemulsion.

18. A composition according to claim 10 wherein said composition is a liquid crystal.

* * * * *

UNITED STATES PATENT AND TRADEMARK OFFICE

CERTIFICATE OF CORRECTION

PATENT NO. : 5,435,936

DATED : July 25, 1995

INVENTOR(S) : Broze et al.

It is certified that error appears in the above-indentified patent and that said Letters Patent is hereby corrected as shown below:

Title page Column 1 under Inventor delete "Inventor" insert –Inventors– and insert after Belgium –and Louis Oldenhove, Heks, Belgium–

Signed and Sealed this

Twentieth Day of February, 1996

*Attest:*

*Attesting Officer*

BRUCE LEHMAN

*Commissioner of Patents and Trademarks*